US005230128A

United States Patent [19]

Norman

[11] Patent Number: 5,230,128

[45] Date of Patent: Jul. 27, 1993

[54] APPARATUS FOR REPLACING DISCHARGE VALVES IN AIR COMPRESSORS

[75] Inventor: Timothy R. Norman, El Dorado, Kans.

[73] Assignee: Texaco Inc., White Plains, N.Y.

[21] Appl. No.: 576,866

[22] Filed: Sep. 4, 1990

[51] Int. Cl.[5] ..... B23P 19/04

[52] U.S. Cl. ..... 29/213.1; 29/890.121; 29/888.42; 137/512.1

[58] Field of Search ..... 29/888.42, 898.067, 29/213.1, 890.121, 890.128, 890.13, 890.132; 137/512.1, 516.11

[56] References Cited

U.S. PATENT DOCUMENTS

| | | | |
|---|---|---|---|
| 1,915,288 | 6/1933 | Bott | 29/898.067 |
| 2,677,449 | 5/1954 | Wavak | 29/898.067 |
| 3,143,133 | 8/1964 | Thomas | 137/512.1 |
| 3,202,467 | 8/1965 | Eckstein | 29/898.067 |
| 3,526,026 | 9/1970 | Warchol | 29/898.067 |
| 4,322,878 | 4/1982 | Warchol | 29/898.067 |
| 4,322,879 | 4/1982 | Warchol | 29/898.067 |
| 4,623,270 | 11/1986 | Olschewski et al. | 29/898.067 |

*Primary Examiner*—Irene Cuda

*Attorney, Agent, or Firm*—Jack H. Park; Kenneth R. Priem; Russell J. Egan

[57] ABSTRACT

A cage for properly positioning replacement valves and bores holds an assembly of a valve member and valve cone in proper relative position during replacement of the valve assembly in the bore of an air compressor.

1 Claim, 3 Drawing Sheets

APPARATUS FOR REPLACING DISCHARGE VALVES IN AIR COMPRESSORS

BACKGROUND OF THE INVENTION

1. The Field of the Invention

The present invention relates to a method and apparatus for replacing discharge valves in air compressors and the like. and in particular to an assembly which greatly facilitates the replacement of the valve in certain Ingersall Rand compressors.

2. The Prior Art

Discharge valves in air compressors and the like are generally of a fairly standard configuration involving a known cylindrical head assembly with springs and feathers (flat spring steel strips) holding head plate members in spaced functional relationship. Usually the head assembly includes a groove, ridge or the like on the free end thereof in which a gasket is seated to effect sealing between the discharge valve and the block of the compressor. An example of this type of valve can be found in U.S. Pat. No. 3,536,094. Heretofore, it has been the standard practice to position the discharge valve in the top or larger end of a valve cone and to insert this assembly valve first into a bore in the block. The assembly is temporarily secured in place in the bore by insertion of a retaining clip spanning the bore and engaging the base of the cone. A valve cover is bolted in place on the compressor block and a set screw carried by the cover is tightened against the cone to properly seat the valve. The insertion of the clip is a rather awkward operation and requires substantial experience in order to be able to make the replacement in, on the average, twenty minutes per discharge valve. Frequently, this operation has required the less experienced mechanic to seek the aid of a more experienced mechanic for guidance and/or assistance. Actual assistance is often difficult since the space available within the bore in which to maneuver makes it very difficult for a second person to get his hands to the necessary locations.

SUMMARY OF THE INVENTION

The present invention concerns a method and apparatus for improving the ease and accuracy of replacement of valves, such as discharge valves in air compressors and the like, requiring less time and manipulation than was heretofore required. The present invention includes a cage member which receives a valve assembly and valve cone therein for proper positioning of the entire valve/cone assembly in a seat in the compressor block. The present invention obviates the previous cumbersome retaining clip which was used to hold the valve and cone in position while the rest of the assembly was secured in place.

It is therefore an object of the present invention to provide a method and apparatus for facilitating the replacement of a valve assembly in a confined bore in a block, such as a discharge valve assembly in an air compressor or the like.

BRIEF DESCRIPTION OF THE DRAWINGS

The present invention will now be described by way of example with reference to the accompanying drawings in which.

DETAILED DESCRIPTION OF THE PREFERRED EMBODIMENT

Figure 1:
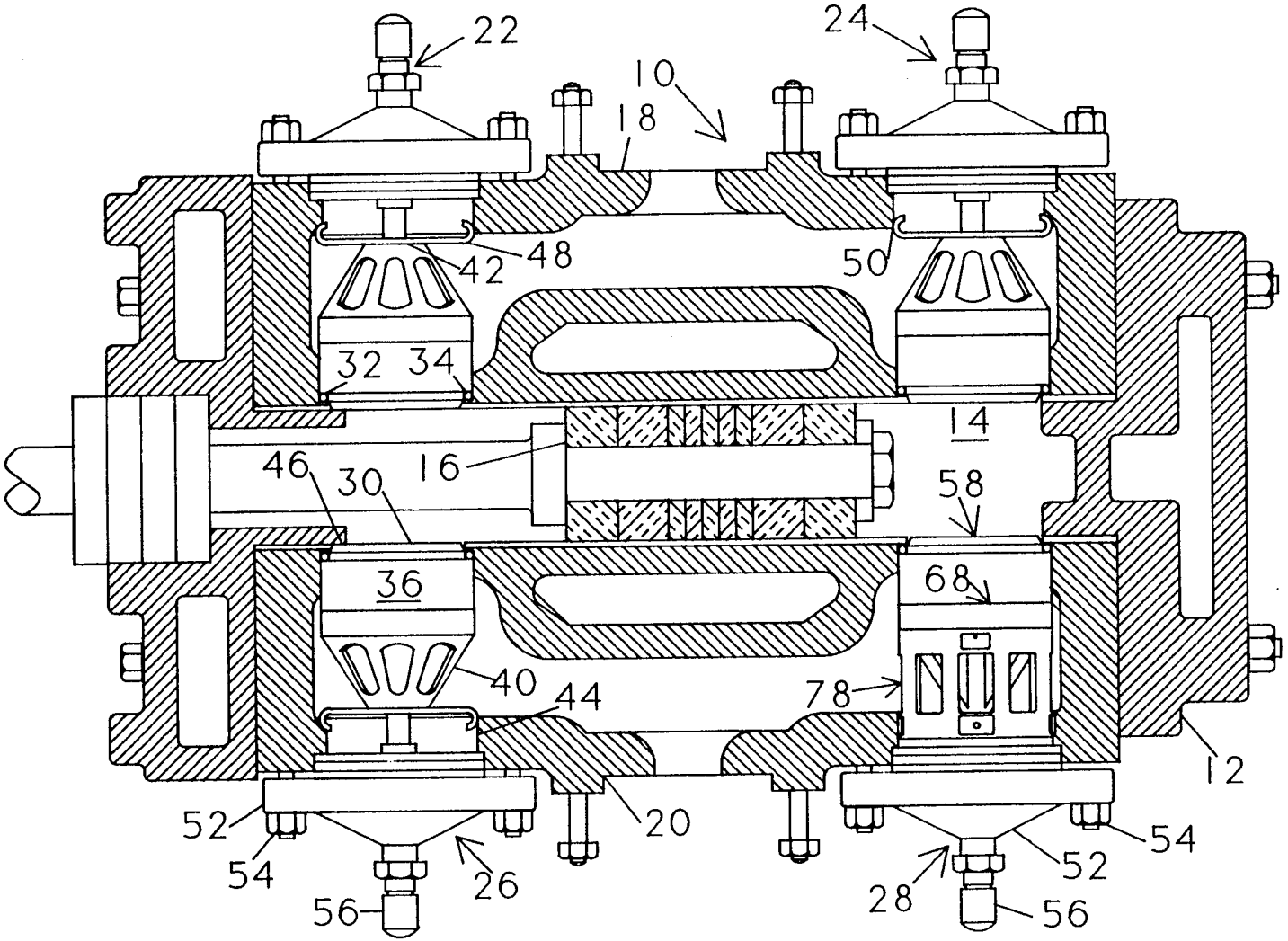
FIG. 1 is a section through a typical air compressor with a prior art valve mounting shown on the left side and the subject invention shown on the right side of the drawing.

FIG. 1 shows a section through a representative air compressor 10, specifically an Ingersall Rand Type SVG; having a housing or block 12 defining a central chamber 14 having therein a reciprocating piston 16. On opposite sides of the chamber there are intake and exhaust manifolds 18, 20, respectively. The intake manifold 18 has therein a pair of intake or suction valve assemblies, 22, 24 while the exhaust manifold 20 has therein discharge valve assemblies 26, 28. Particular attention is directed to the discharge valve assemblies 26 and 28. The former is a prior art version of a typical discharge valve assembly and the latter is a discharge valve assembly according to the present invention.

Turning first to the prior art valve assembly 26, this includes a discharge valve 30 which is generally formed by at least a pair of plates held in functional relation by spring means. None of these details have been shown as they are both well known and are not essential to an understanding of the present invention. A representative valve of this type can be found in the previously mentioned U.S. Pat. No. 3,536,094. The valve 30 has annular recesses on opposite ends thereof, only one of which 32 is visible in FIG. 1. An annular gasket 34 is received in recess 32 and the top or larger annular end portion 36 end of a cone member 38 is received in the other recess.

The cone member 38 includes a plurality of arms 40 having their first ends integral with the annular portion 36 and their second ends converging to form a base portion 42. This assembly of valve 30, cone member 38 and gasket 34 is received in bore 44 of the exhaust manifold 20 with the valve and gasket generally engaging a seat 46. The assembly is held in place by a clip 48, which spans the bore 44 with its ends resting against a rim portion of the valve bore 44 and the center of the clip engaging the base 42 of cone member 38. The discharge valve cover 52 is secured in place by bolts 54 engaging the manifold 18 to close the valve bore 44. Then the valve assembly is properly positioned by adjustment of set screw 56 carried by the cover 52 and acting against the base 42 of cone member 38.

Figure 2:
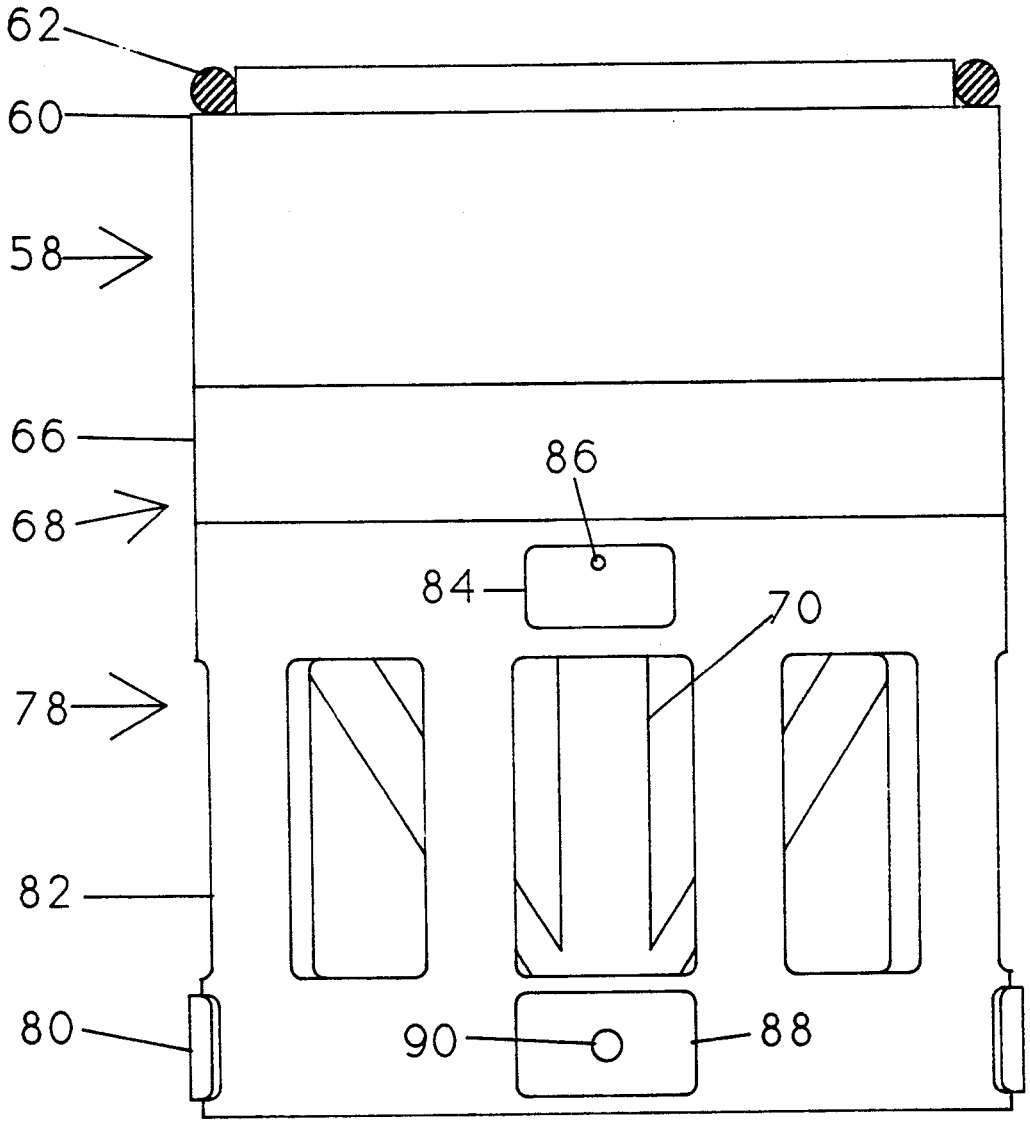
FIG. 2 is an enlarged detailed side elevation of the subject invention with the valve assembly and cage in an assembled condition.
Figure 3:
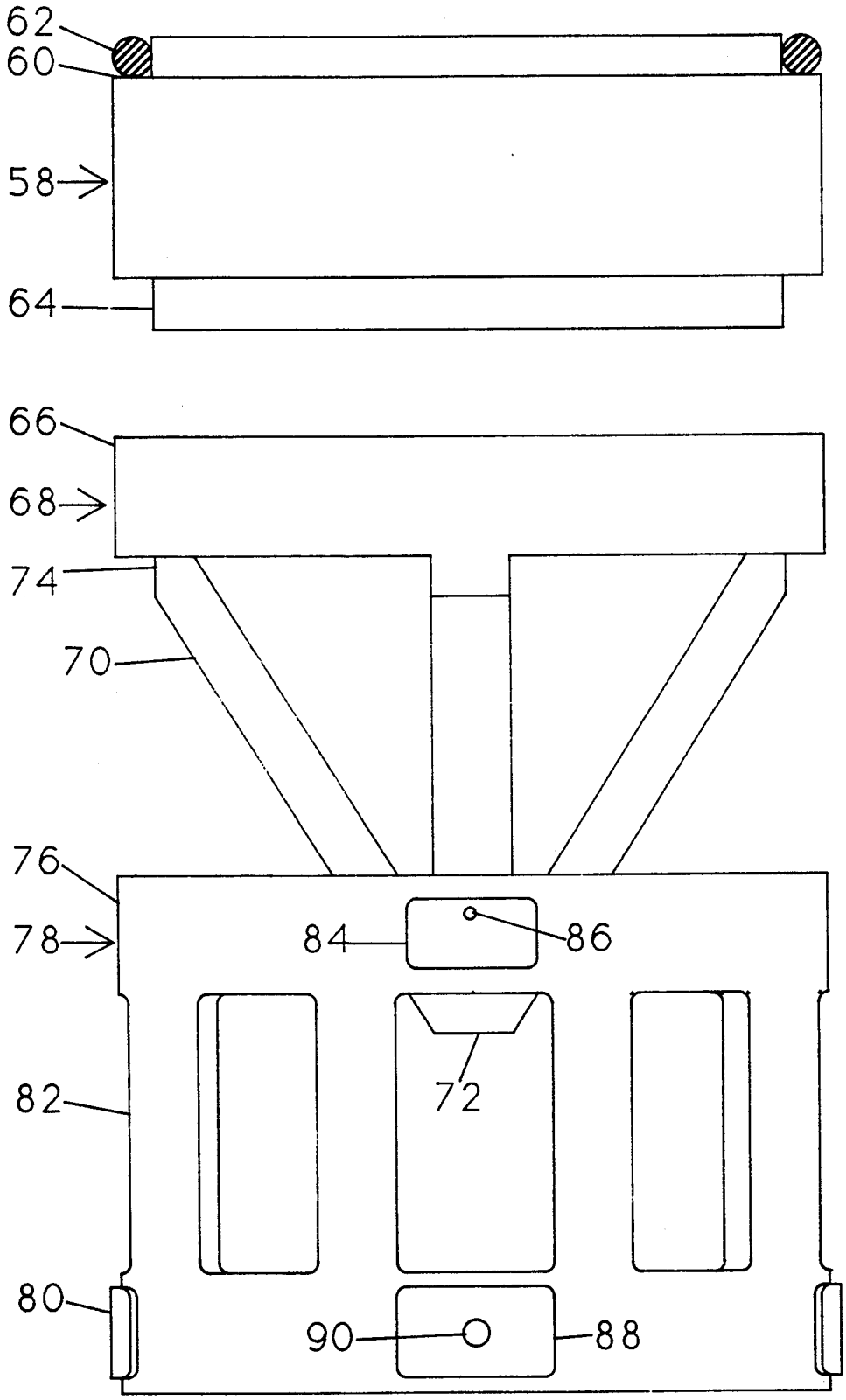
FIG. 3 is a side elevation similar to FIG. 2 showing the subject components in an exploded condition.

The subject valve assembly 28 is shown in detail in FIGS. 2 and 3. The discharge valve 58 is substantially identical to the previously described valve 30. It is profiled on a first end with an annular recess 60 to form a surface which receives an annular gasket 62 therein. The opposite end of the valve is profiled at 64 to form an annular recess which is received in the upper annular end portion 66 of the cone member 68. The cone member 68 is an integral member having a plurality of arms 70 converging from end portion 66 to a base 72. The outer surface of the arms are profiled at 74 with a recess or notch to receive therein the upper annular end of the cage 78. The cage 78 is an integral member having first and second spaced annular portions 76, 80 joined by a plurality of arms 82. The outer surfaces of the first and second end portions 76, 80 can be profiled as desired for fit and rotation prevention. For example, the first portion has a section 84 which is flattened and tapped at 86 to receive therein a set screw (not shown) adapted to engage the cone 68 to secure the cage 78 and cone 68 together. A further section 88 could be provided in second portion 80 and tapped at 90 to receive a further set screw (also not shown) to engage a portion of the manifold 20 to prevent rotation of the valve, cone and cage assembly within the valve bore.

In accordance with the present invention, the assembly of the valve 58, cone 68 and cage 78 is simply inserted into the valve bore 44 of the air compressor 10. The cage 78 serves to hold the assembly in position until the cover 52 is secured in place by bolts 54. The set screw 56 is then adjusted to properly seat the valve in the known manner.

While specific reference has been made to the exhaust valve of an Ingersall Rand air compressor, it will be readily appreciated by those skilled in the art that the present invention will find application for the rapid replacement of valves of this general type, both intake and exhaust, without requiring highly skilled mechanics to accomplish the tasks in a workmanlike manner.

The present invention can be subject to many modifications and changes without departing from the spirit or essential characteristics of the present invention. The above discussed embodiment is therefor intended as illustrative and not restrictive of the scope of the invention as defined by the appended claims.

What is claimed is:

1. An apparatus for properly positioning replacement valves in bores, comprising:

an integral annular cage member having first and second annular end portions interconnected by a plurality of spaced arms and defining an outer surface profiled to be received in one of said bores and an inner surface profiled to receive axially therein a valve assembly including a valve member and a valve cone, means associated with said first annular end portion to fixedly secure said cage member to said valve cone of said valve assembly, and means associated with said first annular end portion to fixedly secure said cage member in said one bore so as to prevent relative rotation therebetween.

* * * * *